United States Patent [19]

Amicel

[11] 4,369,602

[45] Jan. 25, 1983

[54] SURFACE FINISHING DEVICE

[75] Inventor: Charles G. Amicel, Carrieres-sur-Seine, France

[73] Assignee: Bertin & Cie, Plaisir, France

[21] Appl. No.: 214,996

[22] Filed: Dec. 10, 1980

[30] Foreign Application Priority Data

Jun. 18, 1980 [FR] France ..... 80 13484

[51] Int. Cl.[3] ..... B24B 41/00

[52] U.S. Cl. ..... 51/168; 51/170 T; 464/80

[58] Field of Search ..... 51/168, 170 R, 170 T; 64/11 R, 27 NM

[56] References Cited

U.S. PATENT DOCUMENTS

| | | | |
|---|---|---|---|
| 1,777,915 | 10/1930 | Douglas | 51/168 |
| 2,892,326 | 6/1959 | Porter | 64/27 NM |
| 3,024,628 | 3/1962 | Yang | 64/11 R |
| 3,113,407 | 12/1963 | Guilbert | 64/27 NM |
| 4,062,152 | 12/1977 | Mehrer | 51/170 R |

*Primary Examiner*—Harold D. Whitehead

*Attorney, Agent, or Firm*—Staas & Halsey

[57] ABSTRACT

A surface finishing device operates by means of a member designed for polishing, scouring, burnishing or the like and constituted by a resilient structure allowing some distortion along its longitudinal axis. This member has an annular constriction formed from its lateral surface, being designed as bellows formed of successive frustoconical sections.

3 Claims, 6 Drawing Figures

SURFACE FINISHING DEVICE

The present invention relates to a surface finishing device and more specifically to an element, with possibly an accessory, for polishing, scouring, burnishing or effecting a like treatment with respect to a planar or curved surface made of wood, metal, plastics and so on, in the automobile, wood, construction or other art. This invention is of interest in the "do-it-yourself" field.

Surface finishing accessories are as a rule secured to a semi-rigid support which is itself securedly coupled to a motor. Such apparatus, especially when used for polishing, has the drawback of jumping over even on a smooth surface and more particularly of streaking the surface in the form of arcuate streaks.

These drawbacks are due to the rigidity of the support which allows neither damping upon engagement nor adaptation of the tool to adjust the accessory parallel to the worked surface.

A first approach has been to insert, between the accessory and its support, a resilient pad made of cellular material (cf. U.S. Pat. No. 2,950,584 granted Aug. 30, 1960) or a deformable enclosure filled with air (cf. U.S. Pat. No. 2,644,280 granted July 7, 1953).

While this technology allows resolving in part the problems of damping, it does not resolve the inclination which is unsufficient to adapt to the plane of the worked surface.

A second approach consists in fitting a Cardan joint so as to modify the inclination of the accessory relative to the surface (cf. U.S. Pat. No. 4,062,152 granted Dec. 13, 1977). This technology, besides its prohibitive cost, only resolves inclination, without being universal or homokinetic.

These solutions have therefore proved unsatisfactory up to now, and it is not possible to find at present on the market a rotary tool fittable on a motor to fulfil correctly the desired task notably of polishing, at a reasonable price for temporary or even professional use.

The present invention has for its object to provide a surface finishing device fulfilling these requirements.

This device comprises a member one end of which can be coupled to a rotary drive such as a portable electric motor, and the other end of which can be provided with a surface finishing accessory, the member being resilient to allow some distortion along its longitudinal axis. It has at least one annular constriction formed from its lateral surface. This member can be hollowed out and made of molded natural or synthetic rubber, or of molded fabric soaked with rubber of elastic material.

Preferably, the member has the form of bellows constituted by at least two substantially frustoconical walls connected to each other at their major basis and to a terminal end through a constriction. This terminal end may be provided with a generally circular, possibly rigid, platelet having streaks or being formed of an abradant wire lattice.

According to a preferred embodiment of the invention, the platelet comprises at its periphery a flange which cooperates with an annular protrusion or peripheral ring fitted at the terminal end of the member.

Alternatively, the platelet comprises, in lieu of the peripheral flanged end, an annular bent rib located on the platelet and cooperating with the annular protrusion or peripheral ring arranged at the terminal end of the member.

According to another embodiment of the invention, the terminal end is formed of a frustoconical wall which widens out towards the exterior and to which a deformable disc is secured or stuck.

The member further comprises an insert for cooperation with a coupling means.

In the accompanying drawings

Figure 1:
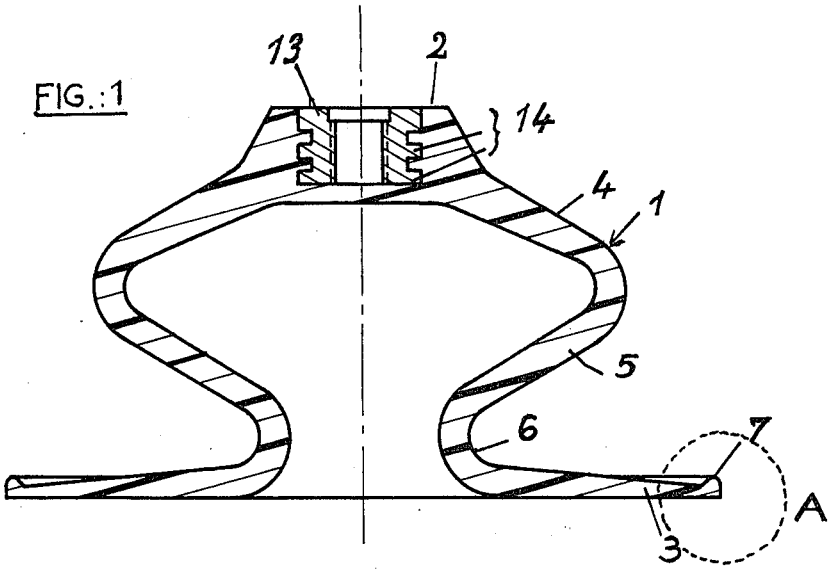
FIG. 1 is a section of a first embodiment of the invention.

On FIG. 1, a surface finishing device is shown which comprises a member 1 the end 2 of which may be coupled to a rotary drive such as a portable electric motor while its other terminal end 3 may be provided with a surface finishing accessory. This member 1 is hollowed out and made of resilient material such as molded natural or synthetic rubber, or of molded fabric soaked with rubber. As seen in section along a longitudinal plane, the member has the general shape of bellows formed of two generally frustoconical walls 4 and 5 connected to each other at their major basis and respectively to the end 2 on the one hand and, through an annular constriction 6, to the terminal end 3 on the other hand.

According to a non-illustrated alternative embodiment, both walls could diverge towards the terminal end, the major basis of one being connected to the minor basis of the other.

Figure 2:
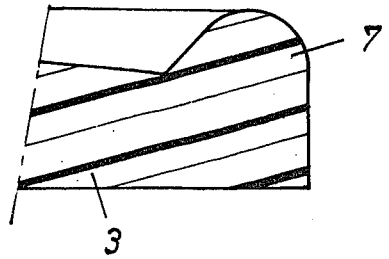
FIG. 2 is a larger scale view of detail A of its terminal end.

Terminal end 3 appears in the shape of a planar disc which has been hollowed out in its center and the thickness of which decreases outwardly to present, at its periphery, an annular protrusion or peripheral rib 7 (see FIG. 2 for detail A).

Figure 4:
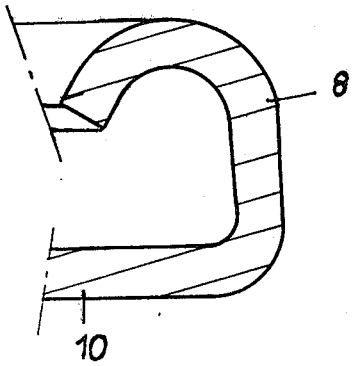
FIG. 4 is a larger scale view of its detail B.
Figure 3:
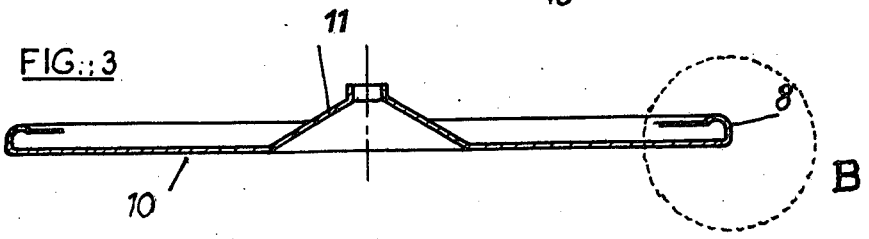
FIG. 3 is a section of an example of platelet.
Figure 5:
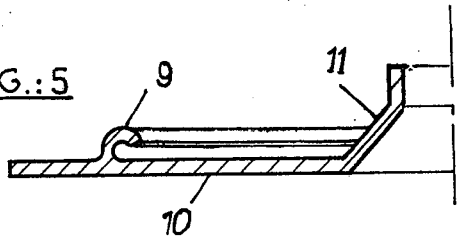
FIG. 5 is a view similar to FIG. 3 showing an alternative form of platelet.

This protrusion can cooperate with a flanged edge 8 (FIGS. 3 and 4) or with a rib 9 (FIG. 5) belonging to a rigid platelet 10 which is removable. This platelet may be in itself abradant by incorporation of streaks or be formed of a lattice-work of abradant wires. Platelet 10 may also conventionally be the support of a surface finishing accessory 1 for polishing, glossing or abrading. This accessory may be secured at the center of the platelet by means of a screw or plug whose head retracts within a swaged housing 11.

Platelet 10 may be of metal—for instance coated steel—swaged or cut from a sheet. It may alternatively be of molded plastics as in the embodiment illustrated on FIG. 5. This embodiment has the advantage of making of avail a set of various diameter platelets which are fittable to a same member. It is particularly convenient for use in truing up a smooth surface.

Figure 6:
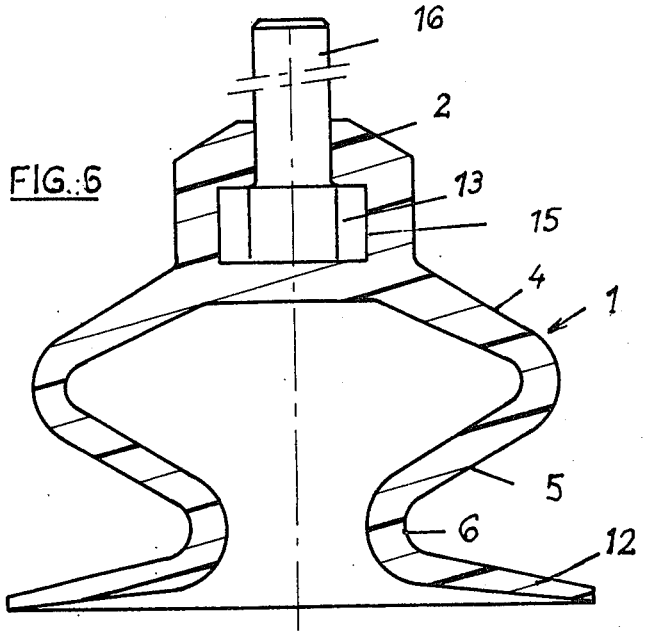
FIG. 6 is a view similar to FIG. 1 showing another embodiment of the member.

The embodiment illustrated on FIG. 6 differs basically from the preceding one in its terminal end 12 which is slightly frustoconical and tapers towards its end. This embodiment is particularly suitable as a flexible, deformable finishing element which may be secured as by gluing and used for polishing, glossing or burnishing especially bosses.

The couplable end of the member is provided with an insert 13 molded therewith. This insert is fast with the member by means of steps 14 (FIG. 1) or cants 15 (FIG. 6).

An integral pin 16 (FIG. 6) or a removable one (not shown on FIG. 1) allows coupling the member to the chuck of a motor.

The frustoconical wall 4 may have an increasing thickness in order to improve the mechanical behavior and the continuity with end 2.

Operation of the invention derives from the above description. It is to be noted that, for a moderate cost, an intermediate member is obtained between a motor and a finishing accessory, ensuring both damping and adaptation of the inclination of its terminal end to the surface to be machined.

Damping is provided on the one hand by the elastic material which is used and on the other hand by the bellows shape of the member which allows longitudinal retraction. Adaptation of the inclination is provided by the annular constriction 6 which plays the part of a knuckle-joint by making up for obliquity between the plane of the finishing accessory and the surface, through rotation about this constriction.

The shape given to the bellows allows return to rest position and stabilization by gyroscopic effect.

As illustrative example, the terminal end of the embodiment of FIG. 1 has a diameter of 122 mm. and a height of 60 mm. To this end is adaptable a platelet of a diameter of 122 mm. or more: e.g. 160 mm. The terminal end of the embodiment of FIG. 6 has a diameter of 20 mm.

The device of the invention applies suitably for the truing up and finishing of a surface, such as polishing, glossing, burnishing by fitting a corresponding finishing accessory, as well as polishing of bosses.

I claim:

1. In combination with a drive shaft and a surface finishing accessory, a device for transmitting to said surface finishing accessory the rotary motion provided from said drive shaft through a single-piece mechanical transmission consisting solely and exclusively in a generally bell-shaped resilient intermediate member having at the input end thereof a flared central vertex couplable to said drive shaft and at the output end thereof a flared peripheral base fittable to said surface finishing accessory, wherein the improvement comprises, between said flared central vertex and said flared peripheral base, an intermediate tapering portion forming a single annular constrictive indentation in the outer surface of said single-piece transmission, whereby the latter is bestowed with universal deformation capacity about its axis of rotation, said surface finishing accessory bearing base being displaceable longitudinally along, laterally from and angularly about said axis.

2. A device as set forth in claim 1, wherein said transmission member comprises two generally frustoconical walls connected to each other through their major basis and respectively to said central input vertex and, through said constrictive indentation, to said peripheral output base.

3. A device as set forth in claim 2, wherein the frustoconical wall connected to the central input vertex has a thickness which increases towards the latter.

* * * * *